US006975099B2

(12) United States Patent
Wu et al.

(10) Patent No.: US 6,975,099 B2
(45) Date of Patent: Dec. 13, 2005

(54) EFFICIENT FREQUENCY COMPENSATION FOR LINEAR VOLTAGE REGULATORS

(75) Inventors: Dolly Y. Wu, Dallas, TX (US); David Grant, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/788,841

(22) Filed: Feb. 27, 2004

(65) Prior Publication Data

US 2005/0189930 A1 Sep. 1, 2005

(51) Int. Cl.[7] ..... G05F 1/56
(52) U.S. Cl. ..... 323/280
(58) Field of Search ..... 323/273, 280, 323/281; 327/538, 540

(56) References Cited

U.S. PATENT DOCUMENTS

| | | | | |
|---|---|---|---|---|
| 5,625,278 | A | 4/1997 | Thiel et al. | |
| 5,631,598 | A | 5/1997 | Miranda et al. | |
| 5,867,015 | A | 2/1999 | Corsi et al. | |
| 6,518,737 | B1 | 2/2003 | Stanescu et al. | |
| 6,690,147 | B2 * | 2/2004 | Bonto | 323/280 |
| 6,710,583 | B2 * | 3/2004 | Stanescu et al. | 323/280 |
| 6,765,374 | B1 * | 7/2004 | Yang et al. | 323/280 |
| 6,841,978 | B2 * | 1/2005 | Schaffer | 323/280 |
| 2005/0040799 | A1 * | 2/2005 | Pannwitz | 323/282 |

FOREIGN PATENT DOCUMENTS

| | | |
|---|---|---|
| EP | 1 111 493 A1 | 6/2001 |
| EP | 1 336 912 A1 | 8/2003 |

OTHER PUBLICATIONS

James K. Roberge, "Operational Amplifiers, Theory and Practice", pp. 610-611 & 180-181, 1975.
Eschauzier et al., "A 100-MHz 100-dB Operational Amplifer with Multipath Nested Miller Compensation Structure", IEEE, 1992.
Texas Instruments, "Low-Noise Operational Amplifiers", 2004.

* cited by examiner

*Primary Examiner*—Adolf Berhane
(74) *Attorney, Agent, or Firm*—W. Daniel Swayze, Jr.; W. James Brady; Frederick J. Telecky, Jr.

(57) ABSTRACT

The present application describes a frequency compensation scheme for a linear voltage regulator circuit, or its special case, a low-drop out voltage regulator (LDO). According to one embodiment, the frequency compensation scheme includes two circuits, an inner loop compensation circuit (240), and a circuit (245) at the output in parallel with one of the resistors of the output voltage divider (235). These two compensation elements (240, 245) are not interdependent and may be adjusted separately to provide more optimal frequency compensation. Advantages include smaller compensation circuit elements, die or board area savings, better phase margin over process technology variations and operating conditions, and ease of design adjustment.

21 Claims, 2 Drawing Sheets

EFFICIENT FREQUENCY COMPENSATION FOR LINEAR VOLTAGE REGULATORS

TECHNICAL FIELD

The present application describes an improved frequency compensation scheme and specific embodiments of the scheme for linear and low dropout voltage regulators.

BACKGROUND

Linear voltage regulator circuits are used to create a clean, well regulated output voltage from some higher, noisy voltage supply source. Such regulator circuits are needed in most electrical systems to provide clean voltage, such as for industrial/automotive circuit applications where the environment is particularly noisy, or such as for wireless applications where the battery power fluctuates and frame synchronization glitches would become very apparent in the audio band.

High performance linear regulator circuits generally have very high gain and need to be frequency compensated in order to have stable performance over a very wide range of operating conditions. The higher the performance and wider the conditions, then the harder it is to provide simple compensation schemes to keep the regulator stable. Conditions include a large range of dropout voltages (difference between input supply voltage Vin and regulated output voltage Vout), a large range of load currents, and a large variety of off-chip capacitors. There is also temperature variation and technology process uncertainty especially for the pass transistor which switches Vin to Vout. Various kinds of frequency compensation schemes are used to provide stability. Examples include Miller compensation, nested Miller loops, and slow-rolloff compensation, along with additional off-chip or off-die load capacitor that may be part of the compensation. It's hard to find simple, small, frequency compensation schemes, which are desirable for cost and compactness reasons; this minimal size preference place further restrictions on the compensation scheme.

FIG. 1A illustrates a prior art typical linear voltage regulator with its frequency compensation element 140, and C load, 150. The goal of the circuit is to monitor the output voltage Vout via feedback and comparing it to some constant valued reference voltage Vref. When Vout is too high or too low, the circuit will self-adjust so that Vout returns to its nominal value, so that Vout remains essentially constant. There are three stages, 110, 120, 130, partly for high gain (performance) purposes. There are several phase and gain shifts resulting from the various high impedance nodes and feedforward paths from the stages and the output objects. The compensation and load capacitors must be selected to avoid too much cumulative phase shift that would create positive feedback and make the circuit unstable. That is, the compensation must balance and locate the poles and zeroes at such frequencies so as to provide sufficient phase margin. High performance voltage regulators often require large or complicated compensation components to be stable. Furthermore, the traditional compensation elements interact with each other and are difficult to adjust independently, making it hard to provide optimal compensation.

SUMMARY

This invention provides a frequency compensation technique that is particularly useful for high gain, high performance linear and/or low dropout voltage regulators which are inherently difficult to stabilize. According to one embodiment, the scheme includes two pieces, an inner loop compensation circuit and a circuit in parallel with one of the resistors in the output voltage divider. The advantages are smaller overall compensation elements, die area and cost savings, along with equal or improved phase margin and performance compared to regulators compensated by prior methods. Another key advantage of this new compensation technique is that design-wise it is simple to apply to get better results: unlike traditional methods like slow roll-off and nested Miller compensation, the new compensation elements are not inter-dependent; so they are easy to adjust independently and hence provide smaller and more efficient compensation. The new compensation for linear regulators allows the placing of poles and zeros strategically to avoid cumulative phase shift that would lead to positive feedback and instability.

The foregoing is a summary and thus contains, by necessity, simplifications, generalizations and omissions of detail; consequently, those skilled in the art will appreciate that the summary is illustrative only and is not intended to be in any way limiting. As will also be apparent to one of skill in the art, the operations disclosed herein may be implemented in a number of ways, and such changes and modifications may be made without departing from this invention and its broader aspects. Other aspects, inventive features, and advantages of the present invention, as defined solely by the claims, will become apparent in the non-limiting detailed description set forth below.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE EMBODIMENTS

Figure 2:
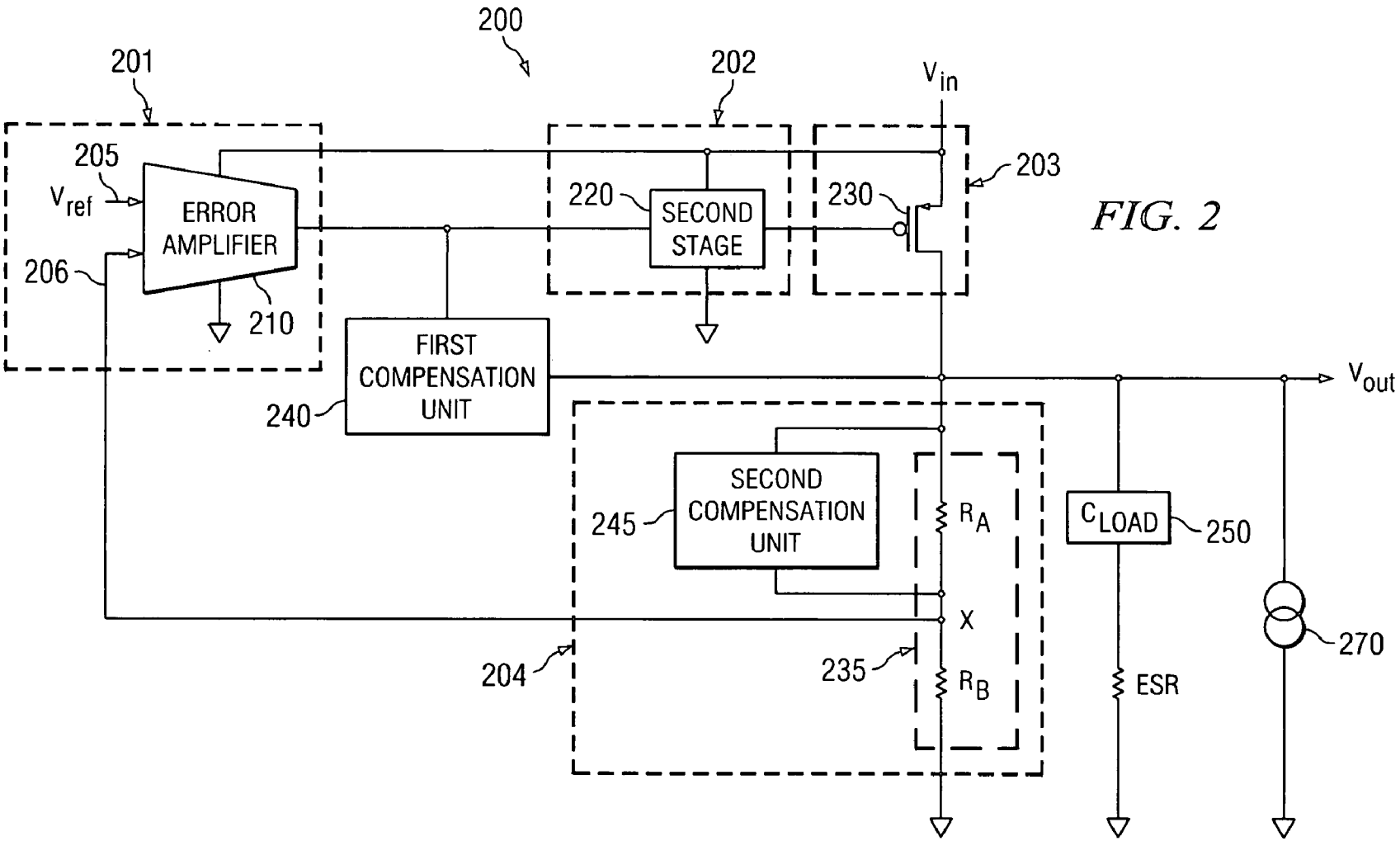
FIG. 2 illustrates an exemplary circuit for a voltage regulator with a frequency compensation scheme for placing independent pairs of poles and zeros.

FIG. 2 illustrates an exemplary circuit for a voltage regulator 200 with a frequency compensation scheme for placing independent pairs of poles and zeros. The voltage regulator 200 includes three circuit stages, input stage 201, second stage 202, and output stage 203, along with voltage divider unit 204. The input stage 201 includes an error amplifier unit 210. The voltage divider unit 204 includes two resistors $R_A$ and $R_B$. The second stage 202 is usually to drive the large input capacitance of the output stage. The second stage usually also contains gain for the regulator to maintain high overall gain when the gain of the output stage becomes very low under light current load conditions. The output stage 203 includes a large pass device transistor 230, usually a P-type or P-channel MOSFET, PMOS common source stage, or its equivalent P-type or PNP transistor for bipolar process technologies. For purposes of illustration, various elements of the voltage regulator 200 are shown and described; however, one skilled in the art will appreciate that the voltage regulator 200 can include additional interface components required for signal tuning for a given application. For example, the second stage may be a transimpedance amplifier containing a resistor as shown in prior art patent, U.S. Pat. No. 5,631,598. Furthermore, various elements of the voltage regulator 200 can be configured using discrete components such as resistors, capacitors, amplifiers and a pass device transistor. Or the various elements may all be inside the IC package or even on the IC die itself, such as the resistors $R_A$ and $R_B$. And this regulator may also be configured on large system ICs to regulate voltages on the large IC and supply current to other circuits on the same IC, or on multi-chip modules within the same package.

The error amplifier 210 receives a reference signal Vref on an input terminal 205 and a feedback voltage from the output of the transistor 230 via a voltage divider 235 on an input terminal 206. The error amplifier 210 generates an error signal representing the difference between the input voltages. The output of the error amplifier unit 210 is coupled to the second stage 220. The second stage outputs a signal which is used to control the pass device transistor 230 to provide a regulated output voltage Vout. The second stage is also often designed to have some non-unity gain magnitude in order to increase the gain of the regulator, but it is typically designed with high bandwidth so that its frequency response has little effect on the overall regulator frequency response.

The regulated output voltage Vout is generated to bias and be the supply for another circuit load, represented by the current load Iload. The output also contains a load capacitor 250 and its associated ESR, electric series resistance. This capacitor is used to aid frequency compensation of the voltage regulator 200, and it is also used to damp any high frequency noise on the regulated voltage Vout so that the noise does not disturb any sensitive circuit loads. This capacitor however should not be so large as to delay intentional load transient responses, startup and shut down conditions, or be so large to take up much area. Therefore, since this load capacitor has a limited range of sizes, it is necessary to have other circuit elements to provide frequency response stability. A first compensation 240 may be used for frequency compensation purposes; it is connected between the output of the regulator, and to the input of the second stage 220. A second compensation unit 245 is connected across the resistor $R_A$ of the voltage divider 235 may be also used for frequency compensation. The second compensation unit 245 allows independent placement of a zero that can cancel an undesirable pole. The zero may also be located around the unity gain frequency of the regulator to lessen the negative phase shift, and thus improve the phase margin. The second compensation unit 245 is a capacitor in a preferred embodiment. The compensation unit 240 can include various configurations shown and described in FIG. 1B, although using a capacitor or a capacitor with series resistor is desirable to minimize component sizes. Circuit units 240 and 245 together are adequate in many designs to provide good phase margin for the regulator 200.

Figure 1A:
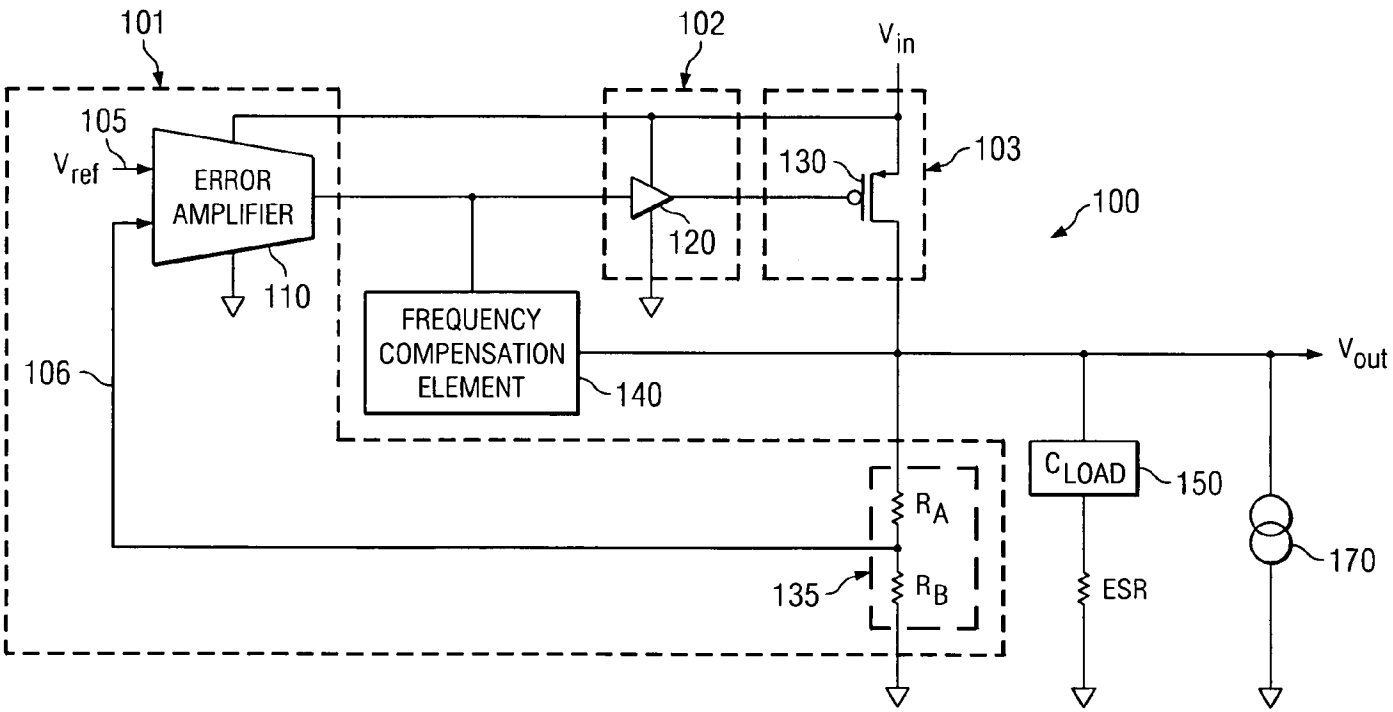
FIG. 1A (PRIOR ART)
FIG. 1A illustrates a conventional frequency compensation scheme for a voltage regulator circuit.
Figure 1B:
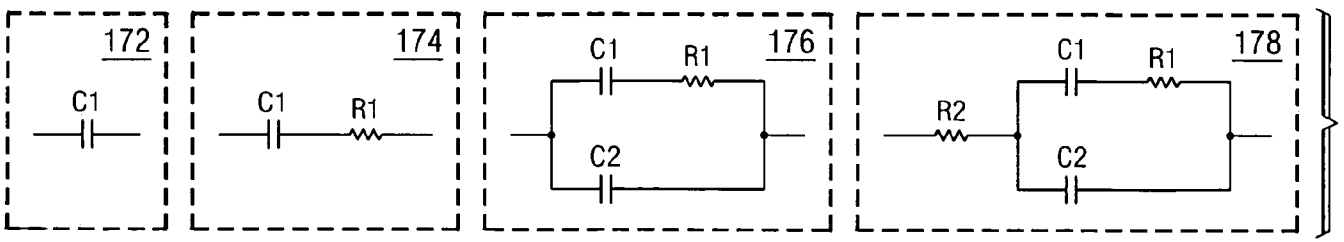
FIG. 1B (PRIOR ART)
FIG. 1B illustrates various configurations for conventional frequency compensation schemes.

A typical inner loop frequency compensation technique is shown in prior art FIG. 1A using the first circuit unit 240 with a configuration of 174, a capacitor and resistor in series, known as Miller plus lead compensation. In this typical prior art case, the poles and zeros of the regulator are as follows. The dominant pole $P_{dom}$ is created by the load capacitance 150 $C_{load}$ and the output resistance of the output transistor 130.

$$P_{dom} \approx \frac{1}{2_(Rds_{130}) * C_{load}} \quad \text{Equation (1)}$$

The poles associated with the first stage unit 110 and second stage unit 120 are as follows. The $G_m$'s are the transconductances of the input transistors of the respective stages. $C_1$ and $Z_{lead}$ (R1) are shown in 174. $C_{2nd}$ stage is the input capacitance of the $2^{nd}$ stage. $C_{_130}$ is the input capacitance of the pass device 130.

$$P_{InputStage} \approx \frac{G_{m1}}{2\pi(C1 + C_{2\text{nd } Stage})} \quad \text{Equation (2)}$$

$$P_{InverterStage} \approx \frac{G_{m2}}{2\pi C_{130}} \quad \text{Equation (3)}$$

Typically, to offset the effect of poles, the lead $Z_{lead}$ compensation scheme introduces a zero at a frequency just above the unity gain frequency to improve the phase margin of the voltage regulator 100. The zero introduced by the Miller-plus-$Z_{lead}$ compensation is given by equation (4):

$$Z_{LEAD} \approx \frac{1}{\left(\left(\frac{1}{G_{m3}}\right) - R1\right) * C1} \quad \text{Equation (4)}$$

$$Z_{ESR} \approx \frac{1}{2\pi R_{ESR} * C_{LOAD}} \quad \text{Equation (5)}$$

The zero associated with the ESR resistor of the load capacitor is given by equation (5), where $Z_{ESR}$ is the impedance of the series resistor of the load capacitance 150, $C_{LOAD}$ is the load capacitance 150, $G_{m130}$ is the transconductance of the pass device transistor 130.

The diagram for this present application is given by FIG. 2. The regulator 100 mentioned previously is now itemized as regulator 200; the first circuit unit 140 is now 240 and so on with respect to labels. When the second compensation unit 245 is configured like in FIG. 1B, as a capacitor $C_{zero}$, an output zero-pole pair is created for the regulator 200. The output zero $Z_{245}$ and pole $P_{245}$ values are given by Equations 6 and 7, where the terms $R_A$ and $R_B$. are the resistors of the voltage divider 235.

$$Z_{245} \approx \frac{1}{2\pi(R_A C_{ZERO})} \quad \text{Equation (6)}$$

$$P_{245} \approx P_{245} \approx \frac{1}{2\pi(R_B C_{ZERO})} \quad \text{Equation (7)}$$

The terms of the pole-zero pairs introduced by the circuit units 240 and 245, illustrated by Equations 6 and 7 do not coincide with the terms of poles and zeros illustrated by Equations 2–5 for the conventional compensation scheme. Furthermore, poles and zeros introduced by the circuit unit 245 do not depend on the intrinsic properties of the internal components of the regulator 200, such as the transconductance of some transistor element. Thus, the frequency location of zero introduced by 245 can be adjusted quite independently of the regulator 200 and the circuit 240, which is also used for compensation purposes. This allows design flexibility and ease. In many instances the zero from circuit 245 is best placed at approximately the unity gain frequency of the regulator in order to reduce the amount of phase shift leading to instability. There is also a corresponding pole created; it follows the zero in frequency location. Therefore, it would occur beyond unity gain frequency if the zero were located around unity; then the pole would not affect stability. Usually, the phase margin from applying both frequency compensation circuit units 240 and 245 is improved by up to about 10 degrees relative to using first compensation unit 240 by itself.

For purposes of illustration, the voltage regulator 200 is configured using three stages; however, regulator 200 can be configured using any number of stages depending on the required gain-bandwidth needs and the operating conditions. Furthermore, both circuit units 240 and 245 can be configured using various combinations of passive elements as applicable for a given regulator 200. In addition, the passive elements can be configured using variable elements. Also, the passive elements can consist of active elements; for example, the resistors can be configured using biased transistors.

A few preferred embodiments have been described in detail herein. It is to be understood that the scope of the invention also comprehends embodiments different from those described, yet within the scope of the claims. Words of inclusion are to be interpreted as nonexhaustive in considering the scope of the invention. While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

The section headings in this application are provided for consistency with the parts of an application suggested under 37 CFR 1.77 or otherwise to provide organizational cues. These headings shall not limit or characterize the invention(s) set out in any patent claims that may issue from this application. Specifically and by way of example, although the headings refer to a "Field of the Invention," the claims should not be limited by the language chosen under this heading to describe the so-called field of the invention. Further, a description of a technology in the "Description of Related Art" is not be construed as an admission that technology is prior art to the present application. Neither is the "Summary of the Invention" to be considered as a characterization of the invention(s) set forth in the claims to this application. Further, the reference in these headings to "Invention" in the singular should not be used to argue that there is a single point of novelty claimed in this application. Multiple inventions may be set forth according to the limitations of the multiple claims associated with this patent specification, and the claims accordingly define the invention(s) that are protected thereby. In all instances, the scope of the claims shall be considered on their own merits in light of the specification but should not be constrained by the headings included in this application.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the exemplary configurations may be implemented as a combined structure or component. These and other variations, modifications, additions, and improvements may fall within the scope of the invention as defined in the claims that follow.

What is claimed is:

1. A voltage regulator comprising:

an output stage having an input and an output, the output operable to provide a regulated output signal;

a first stage having a first input, a second input, and an output, the first input operable to receive a signal reference voltage, the second input operable to receive a compensated signal derived from the regulated output signal, and the output operable to generate a first-stage output signal based at least in part on the first and second inputs;

a second stage having an input and an output, the input operable to receive the first-stage output signal and the output operable to generate a second-stage output signal received at the input of the output stage;

a voltage divider coupled to the output stage output, the voltage divider having at least two circuit elements in series and forming a compensated output at the circuit node between the at least two circuit elements, whereby the compensated signal derived from the output signal is generated at the circuit node;

a first compensation unit coupled between the first-stage output and the output-stage output; and a second compensation unit coupled in parallel with one of the circuit elements of the voltage divider.

2. A voltage regulator according to claim 1, wherein the first compensation unit is operable to provide frequency compensation.

3. A voltage regulator according of claim 1, wherein the second compensation unit is operable to provide frequency compensation.

4. A voltage regulator according to claim 1, further comprising a load capacitor coupled to the output of the output stage.

5. A voltage regulator according to claim 4, further comprising a resistor series-coupled with the load capacitor.

6. A voltage regulator according to claim 1, further comprising a load coupled to the output of the output stage, the load receiving current through the output stage.

7. A voltage regulator according to claim 1, wherein the first compensation unit comprises at least one capacitor.

8. A voltage regulator according to claim 7, further comprising at least one resistor in series with the at least one capacitor.

9. A voltage regulator according to claim 1, wherein the second compensation unit comprises at least one capacitor.

10. A voltage regulator according to claim 1, wherein the output stage comprises at least one metal-oxide semiconductor transistor.

11. A voltage regulator according to claim 10, wherein the at least one metal-oxide semiconductor transistor is a P-type transistor.

12. A voltage regulator according to claim 1, wherein the first stage is a transconductance stage.

13. A voltage regulator according to claim 1, wherein the first compensation unit comprises a variable circuit element.

14. A voltage regulator according to claim 13, wherein the variable circuit element is a variable capacitor.

15. A voltage regulator according to claim 13, wherein the variable circuit element is a variable resistor.

16. A voltage regulator according to claim 1, wherein the second compensation unit comprises a variable circuit element.

17. A voltage regulator according to claim 16, wherein the variable circuit element is a variable capacitor.

18. A voltage regulator of claim 1, wherein the voltage regulator is a low drop-out voltage regulator.

19. A voltage regulator according to claim 1, and further comprising an additional stage in series with the first and second stages.

20. A voltage regulator according to claim 1, wherein the output stage comprises at least one bipolar semiconductor transistor.

21. A voltage regulator according to claim 20, wherein the bipolar transistor is a PNP transistor.

* * * * *